US005409282A

United States Patent [19]

Bale

[11] Patent Number: 5,409,282

[45] Date of Patent: Apr. 25, 1995

[54] CONTAINERS FOR SUPPORTING AND TRANSPORTING STACKED FILES

[76] Inventor: Jeffrey L. Bale, 5525 Woodland St., Stevens Point, Wis. 54481

[21] Appl. No.: 155,381

[22] Filed: Nov. 22, 1993

[51] Int. Cl.[6] ..... A45F 5/12; B65D 37/00

[52] U.S. Cl. ..... 294/152; 294/146

[58] Field of Search ..... 294/138, 149–157, 294/146, 165; 150/154; 190/100, 102, 103, 115, 117, 119; 206/424, 472, 473; 229/87.03, 87.04, 87.06; 281/17, 29, 31, 34, 35

[56] References Cited

U.S. PATENT DOCUMENTS

| | | | |
|---|---|---|---|
| 665,265 | 1/1901 | McComb | 294/138 |
| 741,400 | 10/1903 | Harrington | 294/138 |
| 841,902 | 1/1907 | Shumard | 294/150 X |
| 1,373,136 | 3/1921 | Kranz | 294/138 |
| 1,512,332 | 10/1924 | Goewey | 190/102 X |
| 2,784,890 | 3/1957 | Chisholm | 294/152 |
| 4,470,620 | 9/1984 | Gerch | 281/31 |
| 4,881,684 | 11/1989 | Chinman | 294/152 X |
| 4,958,759 | 9/1990 | Jarvis | 294/138 X |
| 5,083,644 | 1/1992 | Collins | 150/154 X |
| 5,251,945 | 10/1993 | Stoops | 294/152 |

FOREIGN PATENT DOCUMENTS

| | | | |
|---|---|---|---|
| 1470362 | 2/1967 | France | 294/149 |
| 960634 | 6/1964 | United Kingdom | 294/149 |

*Primary Examiner*—Johnny D. Cherry

[57] ABSTRACT

A container for supporting and transporting a plurality of stacked files comprising, in combination, a main body portion in a rectangular configuration having long side edges and short end edges, a horizontal base region extending a short distance from side edge to side edge with angled upper regions extending from side edge to side edge between the end edges to an intermediate location and longer vertical side regions intermediate thereof, a handle fixedly attached to each end edge with a ring strap releasably coupleable to join the handles, a plurality of snaps secured to the side regions of the main body portion for retaining a pair of straps with snaps adjacent to their ends cooperable with the snaps of the side regions.

4 Claims, 3 Drawing Sheets

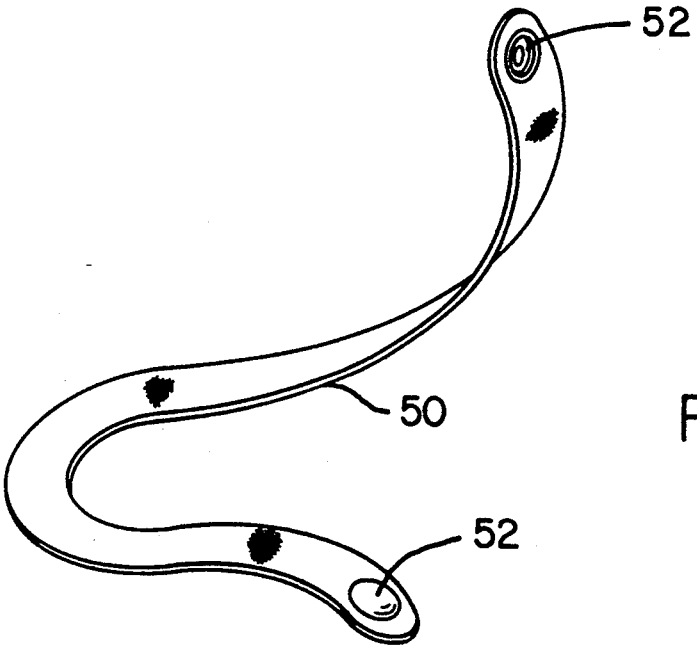
FIG. 3
FIG. 4
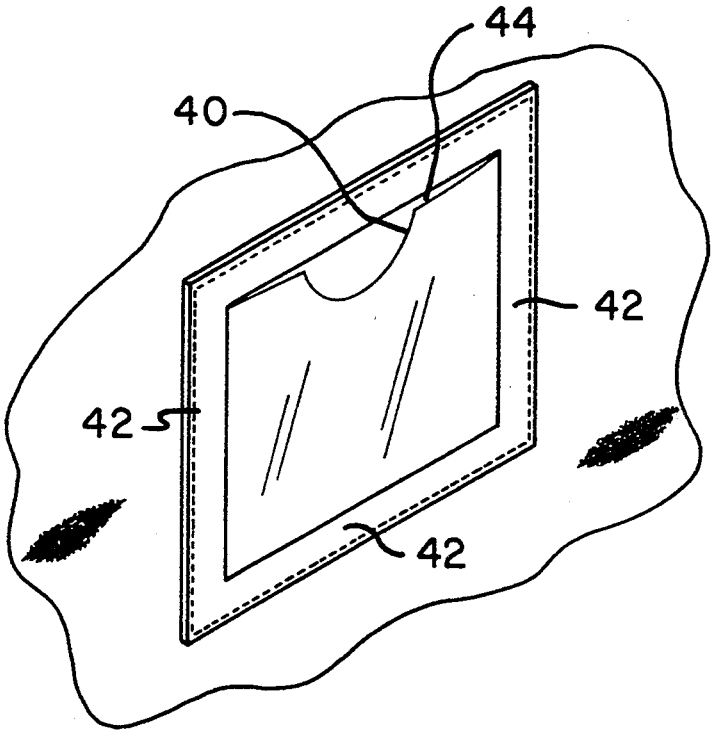

CONTAINERS FOR SUPPORTING AND TRANSPORTING STACKED FILES

BACKGROUND OF THE INVENTION

1. Field of the Invention

The present invention relates to containers for supporting and transporting stacked files and more particularly pertains to containers for stacked files variable in size to accommodate different stack sizes.

2. Description of the Prior Art

The use of file folders is known in the prior art. More specifically, file folders heretofore devised and utilized for the purpose of supporting and transporting files are known to consist basically of familiar, expected and obvious structural configurations, notwithstanding the myriad of designs encompassed by the crowded prior art which have been developed for the fulfillment of countless objectives and requirements.

The prior art discloses various devices associated with files. By way of example, U.S. Pat. Nos. 3,870,223 to Wyant; 4,485,962 to Farley; 5,009,361 to Charlton; 5,090,732 to Kuhns and Des. U.S. Pat. No. 305,486 to Rabig all disclose file folders.

Further U.S. Pat. No. 4,976,340 to Bieber discloses a file folder in a brief case.

In this respect, the containers for supporting and transporting stacked files according to the present invention substantially depart from the conventional concepts and designs of the prior art, and in so doing provide an apparatus primarily developed for the purpose of varying in size to accommodate various sized file stacks.

Therefore, it can be appreciated that there exists a continuing need for new and improved containers for supporting and transporting stacked files which can be varied in size as a function of the size of the stack. In this regard, the present invention substantially fulfills this need.

SUMMARY OF THE INVENTION

In view of the foregoing disadvantages inherent in the known types of file folders now present in the prior art, the present invention provides an improved container for supporting and transporting stacked files. As such, the general purpose of the present invention, which will be described subsequently in greater detail, is to provide a new and improved container for supporting and transporting stacked files apparatus and method which has all the advantages of the prior art and none of the disadvantages.

To attain this, the present invention essentially comprises a container for supporting and transporting a plurality of stacked files comprising, in combination, a main body portion in a rectangular configuration having long side edges and short end edges, a base region positionable horizontally and extending from side edge to side edge a short distance with angled upper regions extending from side edge to side edge adjacent from the end edges to an intermediate location, and the long main body portion also having side regions positionable vertically intermediate the base region and upper regions, a handle fixedly attached to each end edge with a ring strap releasably coupleable to join the handles, a pocket formed of a transparent sheet with three adjacent edges secured to one angled upper region and with an upper edge free for receiving an indicia bearing card, and a pair of elastic straps with snaps adjacent to their ends and cooperable snaps secured to the side regions of the main body portion for retaining a plurality of stacked folders therebetween, the snaps on the side regions including a pair of interior snaps for use in carrying a lesser number of files and a pair exterior snaps for carrying a larger number of files, the interior and exterior snaps being in linear or alignment.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is a further object of the present invention to provide new and improved containers for supporting and transporting stacked files which are of a durable and reliable construction.

An even further object of the present invention is to provide new and improved containers for supporting and transporting stacked files which are susceptible of a low cost of manufacture with regard to both materials and labor, and which accordingly are then susceptible of low prices of sale to the consuming public, thereby making such containers for supporting and transporting stacked files economically available to the buying public.

Still yet another object of the present invention is to provide new and improved containers for supporting and transporting stacked files which provide in the apparatuses and methods of the prior art some of the advantages thereof, while simultaneously overcoming some of the disadvantages normally associated therewith.

Still another object of the present invention is to support and transport stacks of files of varying sizes.

Yet another object of the present invention is to vary the size of a file container as a function of the size of the file stack.

Even still another object of the present invention is to provide new and improved containers for supporting and transporting a plurality of stacked files comprising a main body portion in a rectangular configuration having long side edges and short end edges, a horizontal base region extending a short distance from side edge to side edge with angled upper regions extending from side edge to side edge between the end edges to an intermediate location and longer vertical side regions intermediate thereof, a handle fixedly attached to each end edge with a ring strap releasably coupleable to join the handles, a plurality of snaps secured to the side regions of the main body portion for retaining a pair of straps with snaps adjacent to their ends cooperable with the snaps of the side regions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a perspective view of one of the straps as shown in FIG. 1.

FIG. 4 is a perspective view of the pocket shown in FIGS. 1 and 2.

DESCRIPTION OF THE PREFERRED EMBODIMENT

Figure 1:
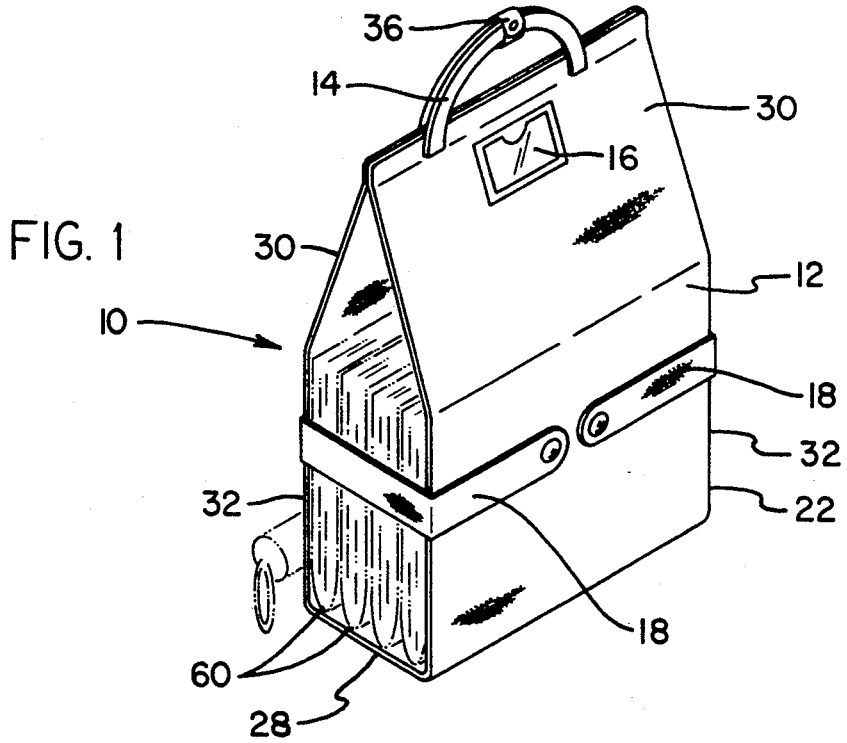
FIG. 1 is a perspective illustration of a container for supporting and transporting stacked files constructed in accordance with the principles of the present invention.
Figure 2:
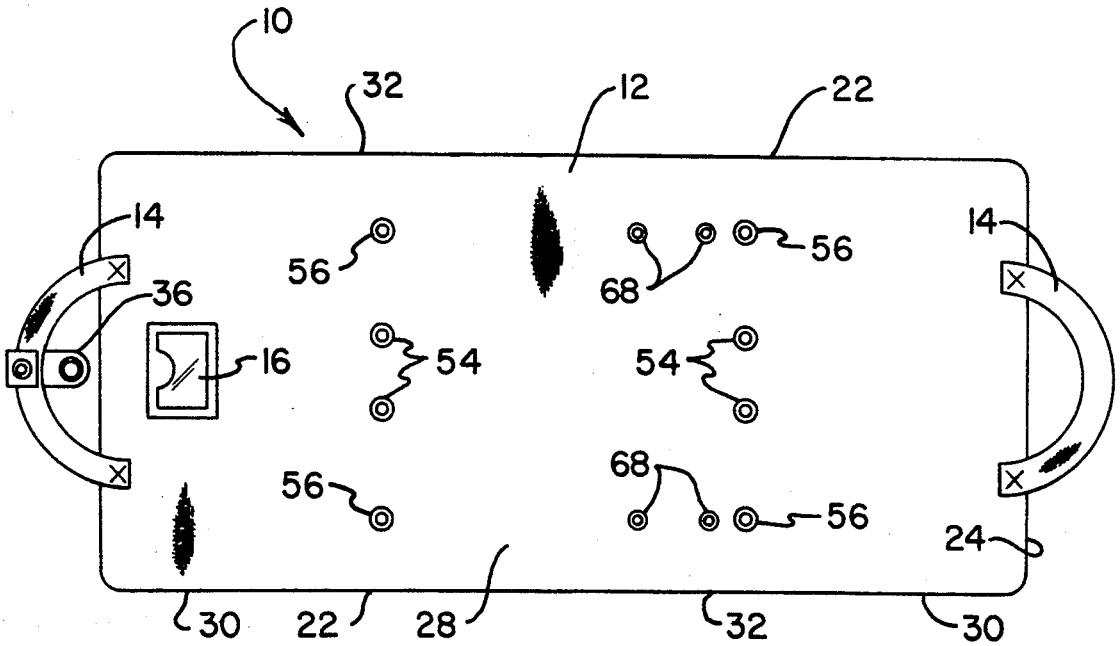
FIG. 2 is a plan view of the main body portion of the containers for supporting amid transporting stacked files shown in FIG. 1.

With reference now to the drawings, and in particular to FIG. 1 thereof, a new and improved container for supporting and transporting stacked files embodying the principles and concepts of the present invention and generally designated by the reference numeral 10 will be described.

More specifically, it will be noted in FIGS. 1 through 4 that the invention relates to a container 10 for supporting and transporting a plurality of stacked files. In its broadest terms, the container 10 includes a main body portion 12, handles 14, a pocket 16 and straps 18.

More specifically, the main body portion 12 is formed in a rectangular configuration. It has long side edges 22 and short end edges 24. A base region 28 is positionable horizontally and extends from side edge to side edge a short distance. Angled upper regions 30 extend from side edge to side edge adjacent from the end edges to an intermediate location. The main body portion 12 also has intermediate side regions 32 positionable vertically intermediate the base region and upper regions.

For ease of grasping and transporting, a handle 14 is fixedly attached to each end edge. A ring strap 36 is also provided to releasably couple and join the handles 14.

Identification is provided through a pocket 16. Such pocket is formed of a transparent sheet 40 with three adjacent edges 42 secured to one angled upper region 30. An upper free edge 44 is for receiving a business card for identification purposes or any other sheet.

Securement of the main body portion 12 into proper position supporting files 60 is effected through a pair of elastic straps 50. The straps are formed with snaps 52 adjacent to their ends. Cooperable snaps 54 are secured to the side regions of the main body portion for retaining a plurality of stacked files or folders 60 therebetween. The snaps on the side regions include a pair of interior snaps 54 for use in carrying a lesser number of files as well as a pair of exterior snaps 56 for carrying a larger number of files. The interior and exterior snaps are in linear alignment parallel with the end edges 24.

Figure 5:
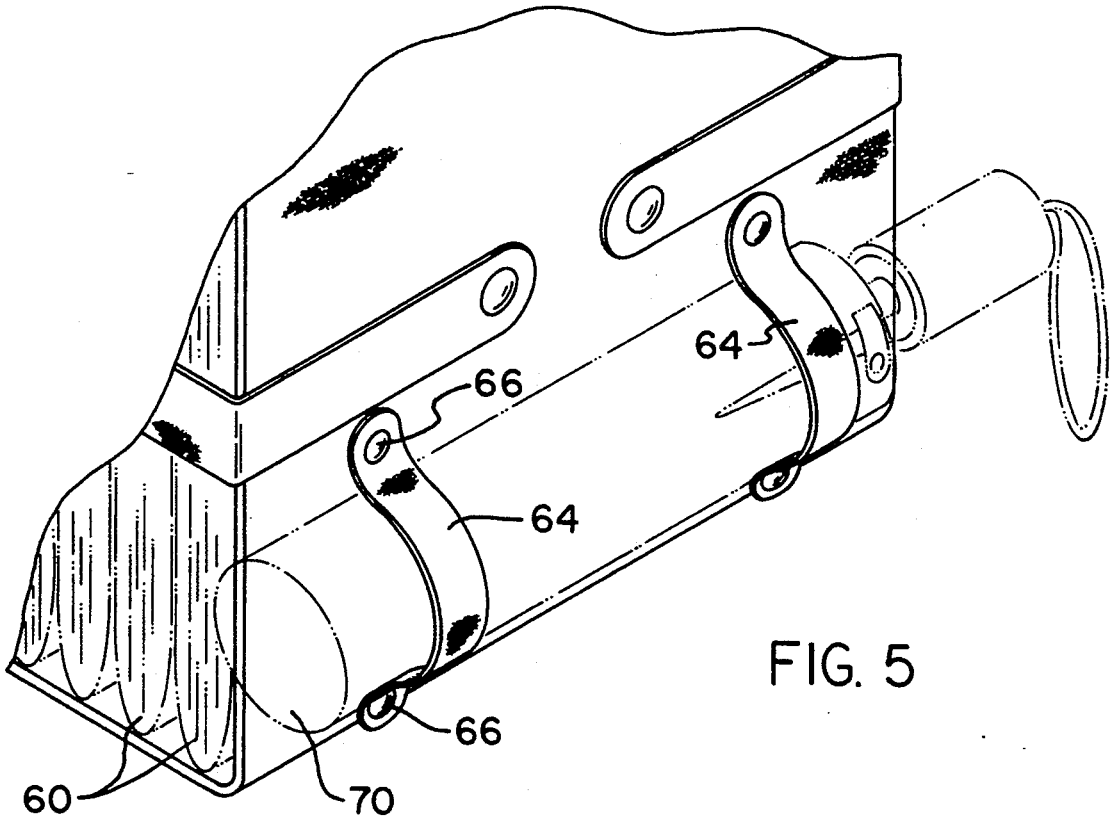
FIG. 5 is a perspective view of the umbrella supporting straps and snaps.

An alternate embodiment of the invention is shown in FIG. 5. In such embodiment, there is further included a pair of supplemental straps 64 with snaps 66. Such straps and snaps are releasably coupleable with additional snaps 68 on the main body portion 12 supporting an umbrella 70.

Figure 6:
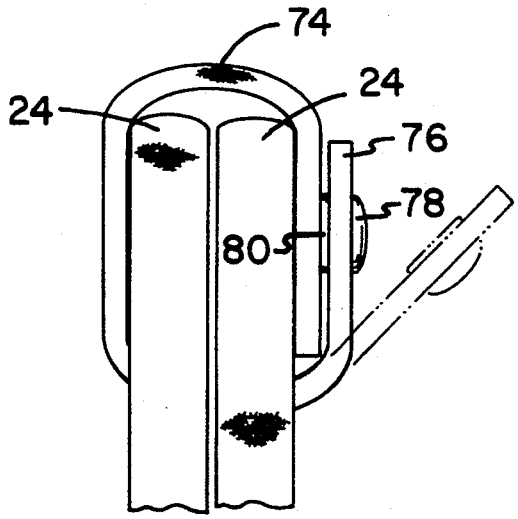
FIG. 6 is an end elevational view of the handle coupling strap of FIG. 1.

Another alternate embodiment of the invention is shown in FIG. 6. In such embodiment, supplemental straps 74 and 76 with coupleable snaps 78 and 80 are secured to opposite end edges 24 for providing a secure closing of the container 10 when in operation and use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships, to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A container for supporting a plurality of stacked files comprising, in combination:

a main body portion in a rectangular configuration having long side edges and short end edges, a base region positionable horizontally and extending from side edge to side edge a short distance with angled upper regions extending from side edge to side edge adjacent from the end edges to an intermediate location, and the main body portion also having side regions positionable vertically intermediate the base region and upper regions;

a handle fixedly attached to each end edge with a ring strap releasably coupleable to join the handles;

a pocket formed of a transparent sheet with three adjacent edges secured to one angled upper region and with an upper edge free for receiving an indicia bearing card; and a pair of elastic straps with snaps adjacent to their ends and cooperable snaps secured to the side regions of the main body portion for retaining a plurality of stacked folders therebetween, the snaps on the side regions including a pair of interior snaps for use in carrying a lesser number of files and a pair of exterior snaps for carrying a larger number of files, the interior and exterior snaps being in linear alignment.

2. A container for supporting and transporting a plurality of stacked files comprising:

a main body portion in a rectangular configuration having long side edges and short end edges, a horizontal base region extending a short distance from side edge to side edge with angled upper regions extending from side edge to side edge between the end edges to an intermediate location and longer vertical side regions intermediate thereof;

a handle fixedly attached to each end edge remote from the longer vertical side regions with a ring strap releasably coupleable to join the handles; and a plurality of snaps secured to the side regions of the main body portion for retaining a pair of straps with snaps adjacent to their ends cooperable with the snaps of the side regions, the snaps on the main body portion include a plurality of pairs of snaps in linear alignment on each side region.

3. The container as set forth in claim 2 and further including a pocket formed of a transparent sheet with three adjacent edges secured to one angled upper region and with an upper edge free for receiving an indicia bearing card.

4. The container as set forth in claim 2 and further including a supplemental strap and associated snaps on one longer vertical side region adjacent to the base region for supporting an umbrella.

* * * * *